US010543490B2

(12) United States Patent
Boehnlein et al.

(10) Patent No.: US 10,543,490 B2
(45) Date of Patent: Jan. 28, 2020

(54) ARRANGEMENT AND METHOD FOR DETACHING AN ADHERING CHARGE FROM AN INNER WALL OF A GRINDING TUBE

(71) Applicant: Siemens Aktiengesellschaft, Munich (DE)

(72) Inventors: Rudolf Boehnlein, Bamberg (DE); Dirk Mensing, Rhede (DE); Juergen Thuilot, Bocholt (DE); Bernd Wacker, Herzogenaurach (DE)

(73) Assignee: Siemens Aktiengesellschaft, Munich (DE)

( * ) Notice: Subject to any disclaimer, the term of this patent is extended or adjusted under 35 U.S.C. 154(b) by 542 days.

(21) Appl. No.: 15/128,366

(22) PCT Filed: Mar. 12, 2015

(86) PCT No.: PCT/EP2015/055212
§ 371 (c)(1),
(2) Date: Sep. 22, 2016

(87) PCT Pub. No.: WO2015/144444
PCT Pub. Date: Oct. 1, 2015

(65) Prior Publication Data

US 2018/0169663 A1 Jun. 21, 2018

(30) Foreign Application Priority Data

Mar. 24, 2014 (EP) ..... 14161257

(51) Int. Cl.
*B02C 17/18* (2006.01)
*B02C 17/00* (2006.01)
(Continued)

(52) U.S. Cl.
CPC ..... *B02C 17/1805* (2013.01); *B02C 17/00* (2013.01); *B02C 17/18* (2013.01); *B02C 17/24* (2013.01); *B02C 25/00* (2013.01)

(58) Field of Classification Search
None
See application file for complete search history.

(56) References Cited

U.S. PATENT DOCUMENTS 3,944,189 A * 3/1976 Singleton ..... B02C 17/02 366/192
4,982,906 A 1/1991 Sakamoto et al.
(Continued)

FOREIGN PATENT DOCUMENTS

CN 2198974 5/1995
CN 2254378 5/1997
(Continued)

OTHER PUBLICATIONS

Office Action dated Jan. 10, 2018 which in the corresponding Chinese Patent Application No. 201580013641.3.

*Primary Examiner* — Shelley M Self
*Assistant Examiner* — Jared O Brown
(74) *Attorney, Agent, or Firm* — Cozen O'Connor

(57) ABSTRACT

An arrangement and method for detaching an adhering charge from an inner wall of a grinding tube, wherein the grinding tube is rotated backwards in a drive-free manner from a pre-determinable, assumed rotary position by the weight force of the adhering charge, where at least one movement state variable of the grinding tube is detected and the grinding tube is braked while being rotated back in dependence on the at least one detected movement state variable in order to detach the adhering charge from the
(Continued)

inner wall of the grinding tube, and where the arrangement includes a detecting device, a drive unit, a braking device and a control device.

9 Claims, 8 Drawing Sheets

(51) Int. Cl.
*B02C 17/24* (2006.01)
*B02C 25/00* (2006.01)

(56) References Cited

U.S. PATENT DOCUMENTS

| | | | | |
|---|---|---|---|---|
| 8,079,536 | B2 * | 12/2011 | Becker | B02C 17/1805 241/30 |
| 9,025,533 | B1 | 5/2015 | Lok et al. | |
| 2002/0031142 | A1 | 3/2002 | Metin et al. | |
| 2003/0052205 | A1 | 3/2003 | Tirschler | |
| 2007/0145168 | A1 * | 6/2007 | Theberge | B02C 17/1805 241/30 |
| 2011/0283504 | A1 | 11/2011 | Becker et al. | |
| 2013/0327859 | A1 | 12/2013 | Holland | |

FOREIGN PATENT DOCUMENTS

| | | |
|---|---|---|
| CN | 2803664 | 8/2006 |
| DE | 10123821 | 12/2001 |
| DE | 102011004416 | 8/2012 |
| EP | 2 525 914 | 5/2013 |
| JP | 53-45783 | 4/1978 |
| JP | 02-245249 | 10/1990 |
| JP | 05-212305 | 8/1993 |
| JP | 06-320035 | 11/1994 |
| JP | 07-51587 | 2/1995 |
| JP | 08-131858 | 5/1996 |
| JP | 02-604297 | 4/1997 |
| JP | 2005-111401 | 4/2005 |
| JP | 2008-022075 | 1/2008 |
| WO | WO 2005/092508 | 10/2005 |

* cited by examiner

ARRANGEMENT AND METHOD FOR DETACHING AN ADHERING CHARGE FROM AN INNER WALL OF A GRINDING TUBE

CROSS-REFERENCE TO RELATED APPLICATIONS

This is a U.S. national stage of application No. PCT/EP2015/055212 filed 12 Mar. 2015. Priority is claimed on European Application No. 14161257.2 filed 24 Mar. 2014, the content of which is incorporated herein by reference in its entirety.

BACKGROUND OF THE INVENTION

1. Field of the Invention

The invention relates to an arrangement and method for detaching an adhering charge from an inner wall of a grinding tube.

Tube mills are used for preference for grinding brittle materials, in particular ore. The grinding process occurs in a horizontally oriented grinding tube of the tube mill. During the grinding process, the grinding tube filled with a charge rotates about its longitudinal axis. Typical tube mills can have a grinding tube with a diameter of 2 m up to 11 m, and a length of up to 25 m. The drive power for such tube mills usually lies in the range from 5 MW up to 15 MW, where use is preferably made of "slipring motors".

It is not uncommon that the operation of such a tube mill is interrupted for a longer period of time, and the grinding tube remains stationary. Such a stationary state can, for example, occur as a result of intermittent loading and unloading of the grinding tube, as a result of maintenance work or due to operational malfunctions.

While the grinding tube is stationary, a solidification or sedimentation, as applicable, of the charge that is in the grinding tube can occur, with adhesion or sticking of the charge to the inner wall of the grinding tube. In this context, one also speaks of an adhering charge or "frozen charge". When operation of the tube mill is resumed, there is a danger that the adhering charge detaches from the inner wall of the grinding tube at a great height, in particular at the highest point of the inner wall diameter, falls down and as a consequence causes damage to the tube mill.

For this reason, tube mills are usually equipped with facilities that recognize the presence of an adhering charge and, in the case that an adhering charge is recognized, halt the tube mill or the rotation of the grinding tube, as appropriate. If an adhering charge is recognized and the tube mill halted as a result, the adhering charge must then be detached from the inner wall of the grinding tube.

From the prior art, various methods are known for releasing an adhering charge from an inner wall of a grinding tube. On the one hand, the adhering charge can be detached by staff using tools, in particular compressed air hammers. Apart from this, WO 2005/092508 A1 discloses a method by which, for the specific purpose of releasing the charge, a drive facility of the grinding tube is actuated to produce an oscillating or increasing rotation of the grinding tube, as appropriate. In addition, EP 2 525 914 B1 discloses a method by which a drive torque applied to the grinding tube is increased with variation by a reference torque.

SUMMARY OF THE INVENTION

It is an object of the invention to provide a method that permits an energy-efficient detachment of an adhering charge, making use of comparatively simple drive and control technology to thereby detach the adhering charge from an inner wall of a grinding tube in an advantageous manner.

This and other objects and advantages are achieved in accordance with the invention by an arrangement and method for detaching an adhering charge from an inner wall of a grinding tube, where the grinding tube is rotated back drive-free, by the weight force of the adhering charge, from a rotational position it has adopted, during which at least one movement state variable of the grinding tube is detected.

The pre-determinable rotational position that is adopted can be a rotational position in which an adequately high restoring torque about an axis of rotation of the grinding tube is imposed on the grinding tube. This restoring torque can result from a force due to the weight of the adhering charge, or from the product of the weight force and a lever arm, as applicable. The restoring force can be considered to be adequately high if it is able to effect an autonomous backward rotation of the grinding tube in the direction of a rotational starting point, or towards a position of stable equilibrium of the grinding tube, as appropriate.

The grinding tube will be rotated back drive-free by the weight force or the restoring torque, as applicable, i.e., accelerates or rotates itself autonomously, as appropriate, in the direction of the equilibrium position. It is expedient if any drive facility that drives the grinding tube during the grinding process, which can, for example, have a slipring motor, is decoupled and/or switched off, is in neutral during the backward rotation.

The at least one movement state variable that is detected can be an angle of rotation, an angular rotational velocity and/or an angular rotational acceleration of the grinding tube.

In the present context and in what follows, the term "detected" is to be understood as a selective detection, an ascertainment, a measurement (in each case in an indirect or a direct manner) or a calculation of a value.

The grinding tube is braked, in a manner depending on the at least one movement state variable that has been detected, for the purpose of releasing the adhering charge from the inner wall of the grinding tube.

It is advantageous if the dependence lies in the achievement of a pre-determinable and/or detected angular rotational velocity and/or angular rotational acceleration of the grinding tube. For example, the grinding tube is braked as soon as it has autonomously reached a certain angular rotational velocity.

It is expedient if the grinding tube is braked by a braking facility, such as a service brake and/or a parking brake. The grinding tube can be braked jerkily, i.e., with the highest possible change in the angular rotational acceleration over a period of time, and/or until a particular deceleration has been reached. It is advantageous if an expediently equipped control or regulation arrangement is present to actuate the braking facility for the purpose of effecting a pre-determinable deceleration.

During the braking, i.e., the acceleration in the opposite direction to the direction of movement of the grinding tube, an inertial force works with a loosening effect on the adhering charge, thus resulting in an advantageous manner in the detachment of the adhering charge from the inner wall of the grinding tube.

It is of particular advantage that the actual detachment of the charge can thus be achieved drive-free. It is thus advantageously possible to avoid actuation of the drive facility of the grinding tube, which is usually not inexpensive, for the purpose of releasing the adhering charge. A further advantage is that it is possible to achieve a not insubstantial saving on the drive energy. It is also of advantage that, for the detachment of the adhering charge, use can be made of a braking facility of the grinding tube, which is usually already present. It is thus possible to achieve a detachment of the adhering charge which, in terms of drive engineering, is particularly cost-effective, energy saving and simple to implement.

Expressed in simplified form, the method provides that from a rotational position in which an adequately high restoring torque is produced by the weight of the adhering charge, the grinding tube starts to rotate autonomously and when it reaches a pre-determinable angular rotational velocity a brake is actuated selectively or proportionately such that, as a consequence of an inertial force thereby evoked, the advantageous result is the detachment of the adhering charge from the inner wall of the grinding tube.

It is also an object of the invention to provide an arrangement for detaching an adhering charge from an inner wall of a grinding tube. This arrangement has a detection facility, a drive unit, a braking facility and a control facility.

The detection facility is equipped such that at least one movement state variable of the grinding tube can be detected.

The detection facility can be equipped with appropriate measurement technology or sensors, as applicable, in order to preferably determine an angle of rotation, an angular rotational velocity and/or an angular rotational acceleration (also: angular deceleration/deceleration) of the grinding tube. By incorporating a tachometer, usually available, preferably in the management technology of a tube mill, into the detection facility it is particularly possible to determine the angle of rotation and the rotational velocity in a particularly cost-effective and reliable manner.

The braking facility is equipped to brake the grinding tube with a deceleration that can be pre-determined.

It is expedient if the braking facility has a service brake and/or a parking brake, each of which is configured to brake the grinding tube. The braking facility can be equipped for the transmission of a braking pressure, a braking force and/or a braking torque to the grinding tube. It is expedient if the braking facility is configured such that the braking pressure, the braking force and/or the braking torque can be controlled or regulated, as appropriate.

Preferably, the braking pressure, the braking force and/or the braking torque will be generated hydraulically.

The control facility is equipped for actuation of the braking facility as a function of the at least one movement status variable that is detected and for actuating the drive unit to switch off any drive activity by the drive unit when the grinding tube adopts a pre-determined rotational position.

It is advantageous if the control facility is equipped for the purpose of controlling the braking pressure, the braking force and/or the braking torque of the braking facility. The control can be effected, in particular, as a function of the angular rotational velocity of the grinding tube, detected by the detection facility.

The invention and the developments described can be realized both in software and also in hardware, for example, making use of a special electrical circuit.

It is further possible to realize the invention or one of the developments described by a computer-readable storage medium, on which is stored a computer program that executes the invention or the development.

It is also possible that the invention and/or each development described is realized by a computer program product, which has a storage medium on which is stored a computer program that executes the invention and/or the embodiment.

In one advantageous embodiment, the pre-determinable rotational position that is adopted is reached by a powered rotation of the grinding tube.

The powered rotation can be effected by a main or auxiliary drive or a drive facility of the grinding tube, as appropriate. It is expedient if the pre-determinable rotational position that is adopted is a position of the grinding tube at which an adequately large restoring torque is evoked by the weight force of the adhering charge. A restoring torque can be adequately large if it is able to effect a drive-free, i.e., autonomous, rotation of the grinding tube in the direction of or tangential to the weight force of the adhering charge. For example, the rotational position adopted can be reached by rotation by an angle of rotation of a size between 80° and 130° starting from a position of rotational equilibrium of the grinding tube. The rotational position that is adopted by driving to it is a position in which advantageously no unwanted detachment or collapse of the adhering charge can occur.

As a result of the driven rotation of the grinding tube against the weight force of the adhering charge, a potential energy of the adhering charge is increased. In this manner, the built up energy can be converted to a kinetic energy by a simple autonomous back rotation of the grinding tube. This kinetic energy is then available for the purpose of releasing the adhering charge. In this manner, it is possible to achieve a detachment of the adhering charge that is particularly simple in drive-engineered terms, because the adhering charge need only be rotated to a rotational position that can be pre-determined.

In a further embodiment, the pre-determinable rotational position adopted by the grinding tube is pre-determined as a rotational angle that is determined as a function of a characteristic of the charge.

The characteristic of the charge can be, as appropriate, a charge quantity or a degree of fullness of the grinding tube, a material-specific characteristic value and/or a value assigned empirically to the charge. For example, with one particular charge the rotational position can be 40°, and with another particular position 80° (in each case depending on the characteristic of the charge). By a determination of this nature of the rotational angle, it is possible in a simple manner to ensure that any unwanted collapse of the charge and possible damage to the tube mill does not occur.

In accordance with one preferred embodiment, the rotational position adopted by the grinding tube is pre-determined as a rotational angle with a magnitude between 40° and 80°, starting from a stable position of equilibrium of the grinding tube.

The stable position of equilibrium of the grinding tube can be a rotational position of the grinding tube in which the potential energy of the adhering charge is minimal and/or is not sufficiently high to cause an autonomous drive-free rotation of the grinding tube. Typically, this situation is reached at a "6 o'clock" setting of the adhering charge.

In one advantageous embodiment, the at least one movement state variable that is detected is a rotational angle, an angular rotational velocity and/or an angular rotational acceleration of the grinding tube.

It is expedient if both the angular rotation and the angular rotational velocity are also detected using a tachometer.

In one advantageous embodiment, the grinding tube is braked to a standstill at least once during the backward rotation.

It is expedient if the grinding tube is braked down to a standstill in a jerky manner, i.e., with the highest possible change in the angular rotational acceleration over a period of time. In this manner, it is possible in a simple manner to generate a particularly high inertial force from the adhering charge, and a correspondingly particularly high detaching force on the adhering charge.

In an advantageous manner, the grinding tube can also be braked more than once, in particular in the case when, after braking to a standstill has been performed, a drive-free rotation will once again start.

In one advantageous embodiment, the grinding tube is braked with a pre-determinable deceleration at least once while being rotated backwards.

The pre-determinable deceleration can be an upper or a lower limiting value. An upper limiting value can, in particular, be derived from a stress limit for the tube mill or the grinding tube, as applicable, in particular its drive facility and/or its braking facility. For example, an upper limiting value can be a value which, if it is exceeded, may be expected to be detrimental to the functioning of the tube mill as a result of excessively high mechanical stresses due to inertial forces. A lower limiting value can, in particular, be a deceleration value below which the adhering charge is not detached from the inner wall of the grinding tube by the inertial forces.

In accordance with one preferred embodiment, the pre-determinable deceleration is determined as a function of a characteristic of the charge.

The pre-determinable deceleration can be a lower limit, below which it is not to be expected that the adhering charge will be detached from the inner wall of the grinding tube.

In a simple manner, it is thus possible to effect a well-adjusted deceleration of the grinding tube without evoking unnecessarily high mechanical stresses on the tube mill or the grinding tube, as applicable, due to inertial forces.

In one advantageous embodiment, the pre-determinable deceleration is determined as a function of a mechanical stress limit for the grinding tube.

The pre-determinable deceleration can be an upper limit, above which it is to be expected that there will be damage to the grinding tube and/or detrimental effects on the functioning of the tube mill, as a result of impermissibly high mechanical stresses due to inertial forces.

By this means, it is possible in a simple manner to avoid mechanical overloading of the tube mill or of the components of the tube mill, as applicable, in releasing the adhering charge from the inner wall of the grinding tube.

In accordance with one preferred embodiment, the drive facility is set up to drive the grinding tube rotationally into a pre-determinable rotational position, where the control facility is set up for the purpose of actuating the drive facility as a function of the at least one movement variable which has been detected and/or the characteristics of the charge. Here, the rotational position that is determined as a function of a characteristic of the charge must not necessarily be determined by the arrangement, but can also be communicated to the control facility as a pre-determined value or an input value, or input into it, as appropriate. It is of particular advantage if the actuation of the drive facility is effected in an especially simple manner, and can be restricted to the activation and deactivation of the drive.

In one advantageous embodiment, the arrangement has a detection unit that is set up to detect a detachment of the adhering charge from the inner wall of the grinding tube as a function of at least one movement state variable of the grinding tube.

It is then possible in a simple manner to determine whether an at least one-time braking of the grinding tube has led to the detachment of the adhering charge from the inner wall of the grinding tube.

In accordance with one preferred embodiment, the braking facility has a mechanical brake, i.e., a drum brake, preferably a disk brake.

Because mechanical brakes have been repeatedly proven, it is advantageously possible to achieve a particularly reliable braking of the grinding tube. Preferably, the braking facility will have a disk brake, by which it is advantageously possible to effect particularly high decelerations, and hence releasing forces.

In one embodiment, the detection facility has a magnetic wheel sensor. Because magnetic wheel sensors have been repeatedly proven and give accurate measurements, it is advantageously possible to achieve a particularly reliable and precise detection, such as detection of the angle of rotation.

The disclosed embodiments of invention additionally provide a grinding tube with an arrangement in accordance with disclosed embodiments of the invention.

The description provided so far of advantageous embodiments contains numerous features that are reflected in the individual subclaims, in some cases with several combined together. However, it is also usefully possible to consider these features individually, and to put them together in further meaningful combinations. In particular, each of these features can be combined individually and in any arbitrary suitable combination with the inventive method together with the inventive arrangement in accordance with the independent claims.

The characteristics, features and advantages of this invention described above, together with the manner in which these are achieved, will be more clearly and more plainly comprehensible in conjunction with the following description of the exemplary embodiments which are explained in more detail in conjunction with the drawings. The exemplary embodiments serve to clarify the invention and do not restrict the invention to the combination of features specified for them, including not in relation to functional features. Apart from this, appropriate features of any particular exemplary embodiment can also be explicitly considered in isolation, separated from an exemplary embodiment, incorporated into another exemplary embodiment for the purpose of augmenting it and/or combined arbitrarily with any of the other claims.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is explained in further detail below with reference to an exemplary embodiment and figures in which.

DETAILED DESCRIPTION OF THE EXEMPLARY EMBODIMENTS

Figure 1:
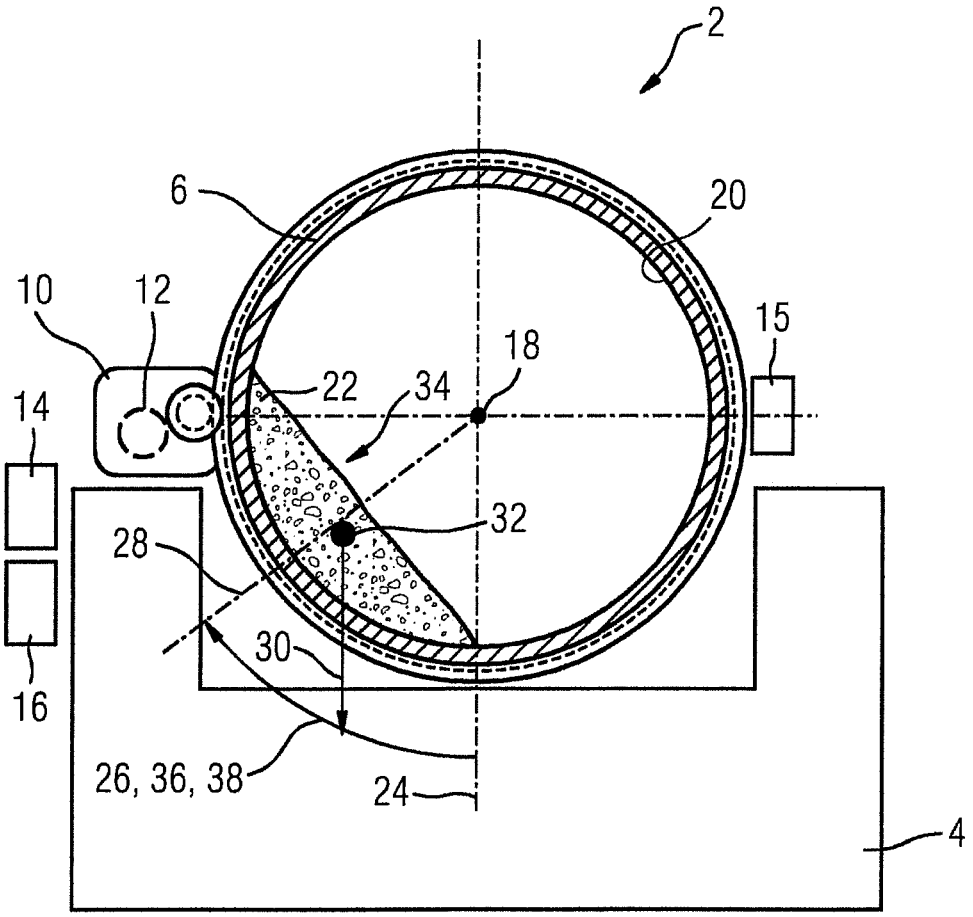
FIG. 1 shows a schematic representation of a tube mill with a grinding tube, onto the inner wall of which adheres an adhering charge.

FIG. 1 shows a schematic representation of a tube mill 2, such as is used, for example, for grinding ore. The tube mill 2 has a structural framework 4, a regular cylindrical grinding tube 6 and an arrangement 8 with a drive facility 10, a braking facility 12 (obscured by the drive facility 10), a detection facility 14 and a control facility 16.

The grinding tube 6 has a bearing mount in the structural framework 4 that allows rotation of the grinding tube 6 about an axis of rotation 18, and is shown in section to improve the view. The grinding tube 6 has an inner wall 20. In the interior of the grinding tube 6 and adhering to its inner wall 20 is an adhering charge 22.

The adhering charge 22 or the grinding tube 6, as applicable, is in a rotational position 28, rotated about a rotational angle 26 from a position of equilibrium 24. In the rotational position 28, a weight force 30 is effective that applies at a center of gravity 32 of the adhering charge 22. The weight force 30 produces a restoring torque about the axis of rotation 18.

During normal operation of the tube mill 2, the drive facility 10 drives the grinding tube 6 in rotation. A charge that is not adhering (not shown here) is consequently broken into smaller pieces by impact, pressure and shear forces, which are transmitted between the charge itself, on the inner wall 20 and by any spheres or cylinders (grinding bodies) that may be present. If the grinding operation of the tube mill 2 is interrupted for a sufficiently long time period, it can happen as described in the introduction that adherence of the charge onto the inner wall 20 of the grinding tube 6, as shown in FIG. 1, comes about.

In the case shown here, with a charge 22 adhering to the inner wall 20 of the grinding tube 6, an unwanted collapse of the adhering charge 22 can occur when the grinding tube 6 is driven by the drive facility 10 beyond a certain rotational position, such as a rotational position in the quantitative range of 90° to 180°, as a consequence of the detaching weight force 22 that then applies more strongly. Here, the angular rotation that can lead to a collapse of the adhering charge 22 is dependent, among other factors, on a characteristic 34 of the charge, such as a level of filling of the grinding tube 6 or a material property of the adhering charge 22.

The detection facility 14 is equipped for determining the current angular rotation 26 or the current rotational position 28, as appropriate, an angular rotational velocity 36 and/or an angular rotational acceleration 38 of the grinding tube 6. The detection facility has a magnetic wheel sensor 15 which, as shown in FIG. 1, need not necessarily be an integral component of the detection facility, but can also be arranged separately from the detection facility.

The braking facility 12 is constructed such that the grinding tube 6 can be braked as a function of the angular rotational velocity 36 and/or the angular position 28 or the angular rotation 26, as appropriate. The braking facility 12 is constructed to transmit to the grinding tube 6 a braking pressure, a braking force and/or a braking torque. Apart from this, the braking facility 12 is constructed such that the braking pressure, the braking force and/or the braking torque can be controlled or regulated. That is, the braking facility 12 is constructed to be actuated by the control facility 16.

The control facility 16 is set up to control or regulate, as appropriate, the braking pressure, the braking force and/or the braking torque as a function of the angular rotational velocity 36, the charge characteristic 34 and/or the angular rotational acceleration 38 of the grinding tube 6.

For the purpose of releasing the adhering charge 22 from the inner wall 20 of the grinding tube 6, the drive facility 10 moves the grinding tube 6, starting from the position of equilibrium 24, into the rotational position 28, where the rotational position 28 can have a functional dependence on the characteristic 34 of the charge. Here, the rotational position that is driven to can of course also be in a direction of rotation opposite to that shown in FIG. 1. What is decisive is only the magnitude of the angular rotation 26.

After the rotational position 28 has been reached, and the switching off or uncoupling, as applicable, of the drive facility 10, the grinding tube 6 rotates drive-free (autonomously) (as a result of the weight force 30 or the restoring torque resulting from the weight force 30 and the rotational axis 18) in the direction of the position of equilibrium 24, opposite to the direction of rotation due to the drive. The detection facility 14 detects, particularly during the autonomous rotation of the grinding tube 6 from the rotational position 28, the rotational angle 26 that establishes itself, the angular rotational velocity 36 and/or the angular rotational acceleration 38 of the grinding tube 6.

Depending on the angular rotational velocity 36 thus detected, the control facility 16 controls the braking pressure or the braking force or the braking torque, as applicable, of the braking facility 12 on the grinding tube 6 such that an expedient braking of the grinding tube 6 results. The braking of the grinding tube 6 results in an inertial force of the adhering charge 22, with a detaching effect on the adhering charge, so that a detachment of the adhering charge 22 from the inner wall 20 of the grinding tube 6 advantageously results.

The grinding tube 6 is braked, in particular, as a function of the characteristic 34 of the charge. That is, for example, depending on the characteristic 34 of the charge, the braking facility 12 brakes the grinding tube as rapidly as possible down to a standstill, or with a pre-determinable angular rotational acceleration 38, or a pre-determinable deceleration 48, as appropriate. In addition, the pre-determinable deceleration 48 can be oriented in accordance with a mechanical stress limit for the grinding mill 2. In this manner, it is possible to ensure that no mechanical overloading of the braking facility 12 or of the tube mill 2, as appropriate, arises from excessively strong braking.

If, after braking of the grinding tube 6 has been effected once, no detachment of the adhering charge 22 has occurred, the procedure can be repeated until the grinding tube 6 has reached the position of equilibrium 24 or until the restoring torque generated by the weight force 32 is no longer sufficient to set the grinding tube 6 into an autonomous rotation.

After an unsuccessful rotation back into the equilibrium position 24, the grinding tube 6 can once again be rotated into the rotational position 28, preferably into a rotational position with greater rotation, and the further process steps for releasing the adhering charge 22 can be executed once again.

Figure 2:
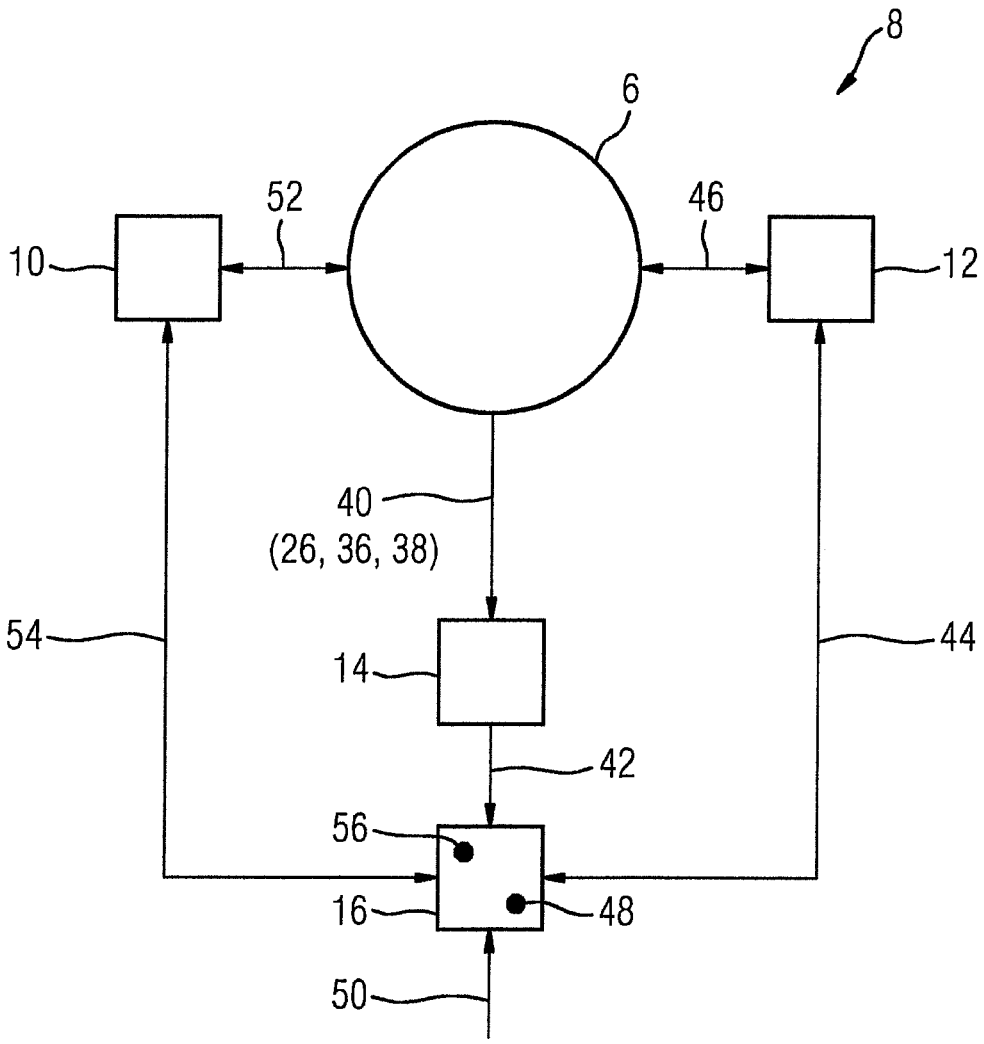
FIG. 2 shows a schematic structure of a control or regulation arrangement, as applicable, for detaching an adhering charge from the inner wall of a grinding tube in accordance with the invention.

FIG. 2 shows a schematic structure of a control or regulation arrangement 8, as applicable, for the detachment of an adhering charge 22 from the inner wall 20 of a grinding tube 6 (20, 22 see FIG. 1).

The arrangement 8 has a drive facility 10, a braking facility 12, a detection facility 14 and a control facility 16.

For the purpose of releasing an adhering charge 22 from the inner wall 20 of the grinding tube 6, the detection facility 14 detects at least one movement state variable 40 of the grinding tube 6. The at least one movement state variable 40 or the movement state variables 40, as applicable, is/are preferably a rotational angle 26, an angular rotational velocity 36 and/or an angular rotational acceleration 38 that the grinding tube 6 will adopt under an autonomous weight-force induced rotation.

A value of the at least one movement state variable 40 is communicated as a measurement signal 42 to the control facility 16.

Via a control signal 44, the control facility 16 actuates the braking facility 12 as a function of the at least one movement state variable 40, preferably as a function of the angular rotational velocity 36 and the angular rotational acceleration 38.

The braking facility 12 brakes the grinding tube 6 selectively by an application of a braking torque 46 (also: braking-pressure, -force), where the braking torque 46 can be regulated or at least controlled as a function of the movement state variable 40, preferably the angular rotational acceleration 38, detected by the detection facility 14.

A pre-determinable deceleration 48 is stored as a data item or a value, as applicable, in the control facility 16. The pre-determinable deceleration 48 can be a temporarily constant value, or one that can be changed over time, which in particular is dependent on a charge characteristic 34 of the adhering charge 22 (22, 34 see FIG. 1). The charge characteristic 34 is input into the control facility 16 in the form of an input value 50, which can also be a set of values, or is detected by it. Here, the input value 50 will preferably relate to material-specific characteristics of the adhering charge 22 and/or to a level of filling of the grinding tube 6.

The braking facility 14 brakes the grinding tube, or is actuated by the control facility 16 via the control signal 44, such that the pre-determinable deceleration 48 is not exceeded (in the case of an upper limiting value) or is at least reached (in the case of a lower limiting value), as applicable.

If an adequately high angular rotational acceleration 38 (deceleration) is achieved as a result of the braking, for the reasons described in the introduction this causes a detachment of the adhering charge 22 from the inner wall 20 of the grinding tube 6.

At a point in time before this, the grinding tube 6 is rotated by a driving torque 52 (also: driving force), applied by the drive facility 10, into an expedient rotational position. The rotation occurs, as described in the introduction, against a restoring torque from the adhering charge 22 and is controlled by the control facility 16 via a control signal 54.

Here, the actuation of the drive facility 10 by the control facility is preferably effected as a function of the charge characteristic 34 of the adhering charge 22, i.e., as a function of the input value 50. That is, the rotational position that is to be adopted is determined as a function of the input value 50 or is in some other manner stored in the control facility 16 as a pre-determinable rotational position 56.

Figure 3:
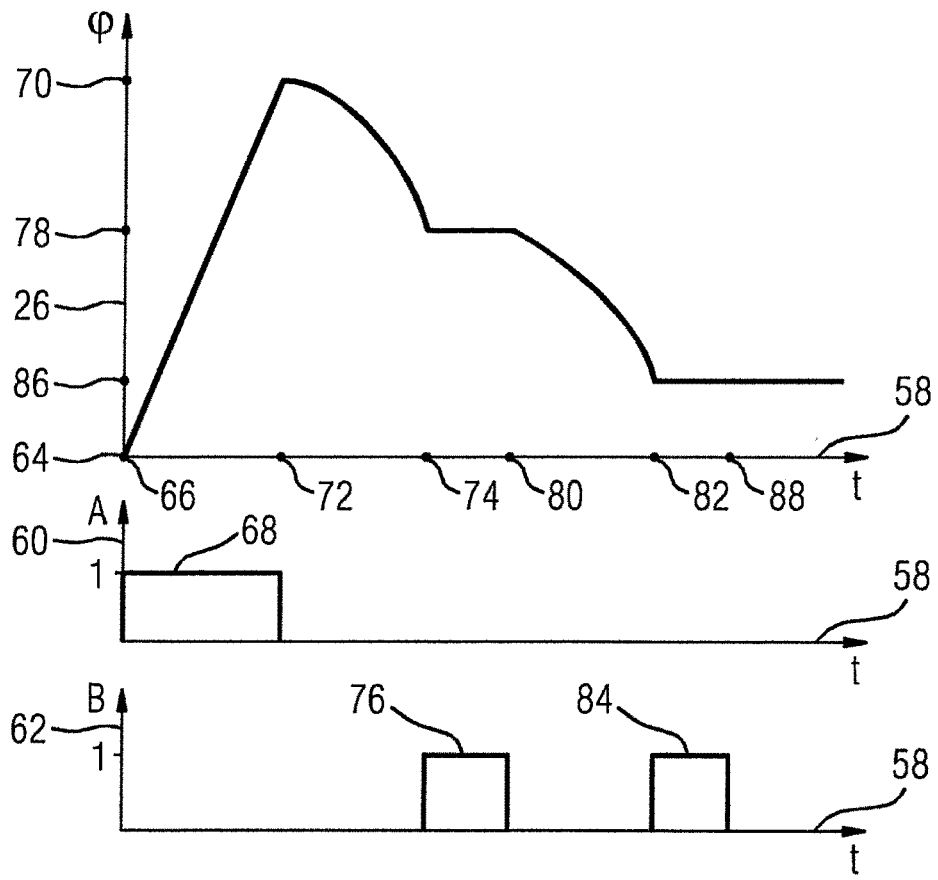
FIG. 3 shows a graphical plot of a rotational angle against time, with corresponding graphs of the activities of a drive and a brake in accordance with the invention.

FIG. 3 shows a diagram with a graphical plot of a rotational angle 26 (ordinate [–]) for a grinding tube 6 against time 58 (abscissa [s]) during the detachment of an adhering charge 22 from an inner wall 20 of a grinding tube 6 (6, 20, 22 see FIG. 1). Also shown are corresponding graphs of a drive activity 60 (ordinate [–]) and a braking activity 62 (ordinate [–]), each against time 58, where the three time axes shown are identical.

Starting from a position of equilibrium 24 of the grinding tube 6 (see, e.g., FIG. 1) in a rotational position 64 at point in time 66, the grinding tube 6 is rotated by a drive activity 68 into a rotational position 70 at a point in time 72. During the drive activity 68, between the time points 66 and 72, a drive torque 52 (see, e.g., FIG. 2) is transmitted to the grinding tube 6 (see, e.g., FIGS. 1, 2), where no explicit graph of the drive torque 52 is reproduced at this point for purposes of clarity.

After a switch-off of the drive activity 68 at the time point 72, the grinding tube rotates autonomously, as explained above, as a result of the weight force of the adhering charge, in the opposite direction of rotation from that previously effected by the drive activity 68. In the course of this, the angular rotational speed increases.

At a point in time 74, a braking activity 76 effects a sharp braking of the grinding tube, where the grinding tube comes to a halt in a rotational position 78. During the braking activity 76, between the time points 74 and 80, a braking torque 46 (see, e.g., FIG. 2) is transmitted to the grinding tube 6 (see, e.g., FIGS. 1, 2), where the explicit graph of the braking torque 46 is not reproduced at this point for purposes of clarity. The braking activity 76 is terminated at a time point 80, whereupon the grinding tube 6 once again starts to rotate autonomously and accelerates. Here, the detectable angular rotational acceleration is smaller, by comparison with the angular rotational acceleration of the original backwards rotational movement at the time point 72, as a consequence of the now reduced restoring torque due to lever arm of the adhering charge 22.

At a later point in time 82, another sharp braking of the grinding tube 6 is effected by another braking activity 84, where the grinding tube comes to a halt at a rotational position 86. The braking activity 84 is terminated at a time point 88, where the grinding tube does not this time autonomously start to rotate, but pauses with the charge now detached in the rotational position 86.

Figure 4:
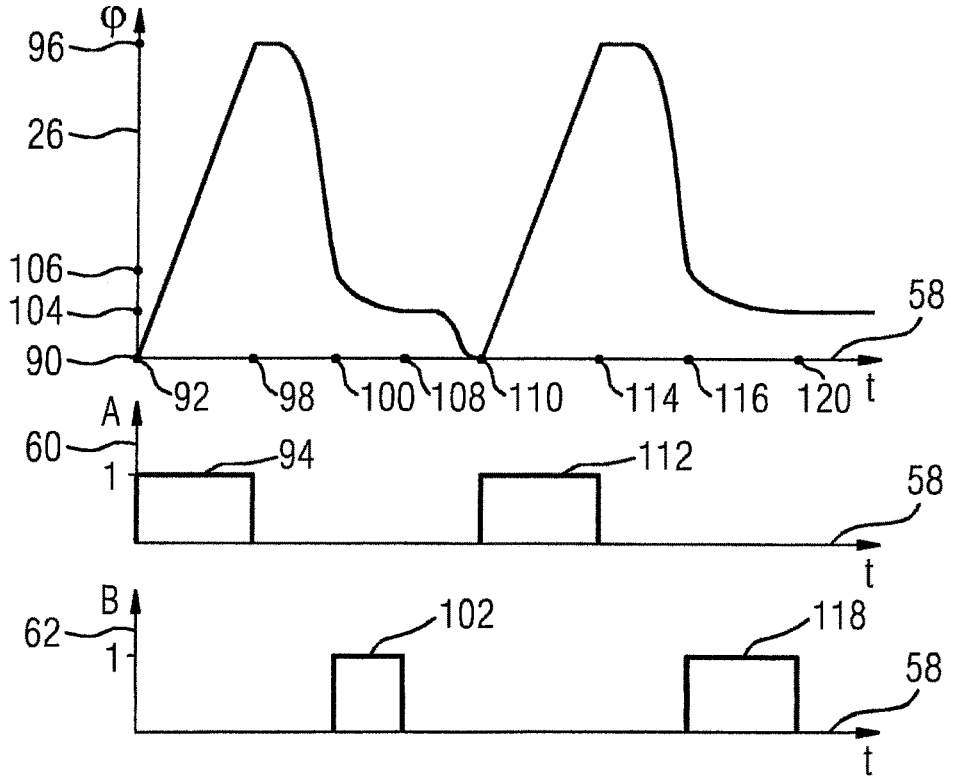
FIG. 4 shows another graphical plot of a rotational angle against time, with corresponding graphs of the activities of a drive and a brake in accordance with the invention.

FIG. 4 shown a further diagram with a graphical plot of the rotational angle 26 (ordinate [–]) of a grinding tube 6 against time 58 (abscissa [s]) during the detachment of an adhering charge 22 from an inner wall 20 of a grinding tube 6 (6, 20, 22 see FIG. 1). Also shown in turn are corresponding graphs of a drive activity 60 (ordinate [–) and a braking activity 62 (ordinate [–]), shown in each case against time 58, wherein the three time axes shown are identical.

Starting from a position of equilibrium 24 of the grinding tube 6 (see, e.g., FIG. 1) in a rotational position 90 at a point in time 92, the grinding tube 6 is rotated by a drive activity 94 into a rotational position 96 at a time point 98.

After a switch-off of the drive activity 94 at the time point 98, the grinding tube 6 rotates autonomously, as explained in the introduction, as a result of the weight force of the adhering charge, in the opposite direction of rotation from that previously effected by the drive activity 94. In the course of this, the angular rotational speed increases.

At a point in time 100, a braking activity 102 effects a braking of the grinding tube 6 until it reaches a pre-determinable deceleration 48 (see, e.g., FIG. 2), where the grinding tube 6 comes to a halt in a rotational position 104. That is, unlike the exemplary embodiment shown in FIG. 3, the grinding tube 6 is not braked sharply but in a carefully regulated manner. The braking activity 102 is initiated at a rotational position 106 and preferably as a function of the angular rotational speed 36 detected at this time point (see, e.g., FIGS. 1, 2). The braking activity 102 is terminated at a time point 108, whereupon the grinding tube 5 once again starts to rotate autonomously until at the time point 110 the position of equilibrium 24 (see, e.g., FIG. 1) is once again reached, or the rotational position 90 is reached without the detachment of the adhering charge 22, as applicable.

A detachment of the adhering charge 22 from the inner wall 20 of the grinding tube 6 is effected by a renewed drive activity 112 between the time points 110 and 114, an autonomous acceleration of the grinding tube between the time points 114 and 116, and a further braking activity 118 between the time points 116 and 120. As a consequence, after the termination of the braking activity 118 there is no renewed rotation of the grinding tube, but the grinding tube pauses in the rotational position 104.

Figure 5:
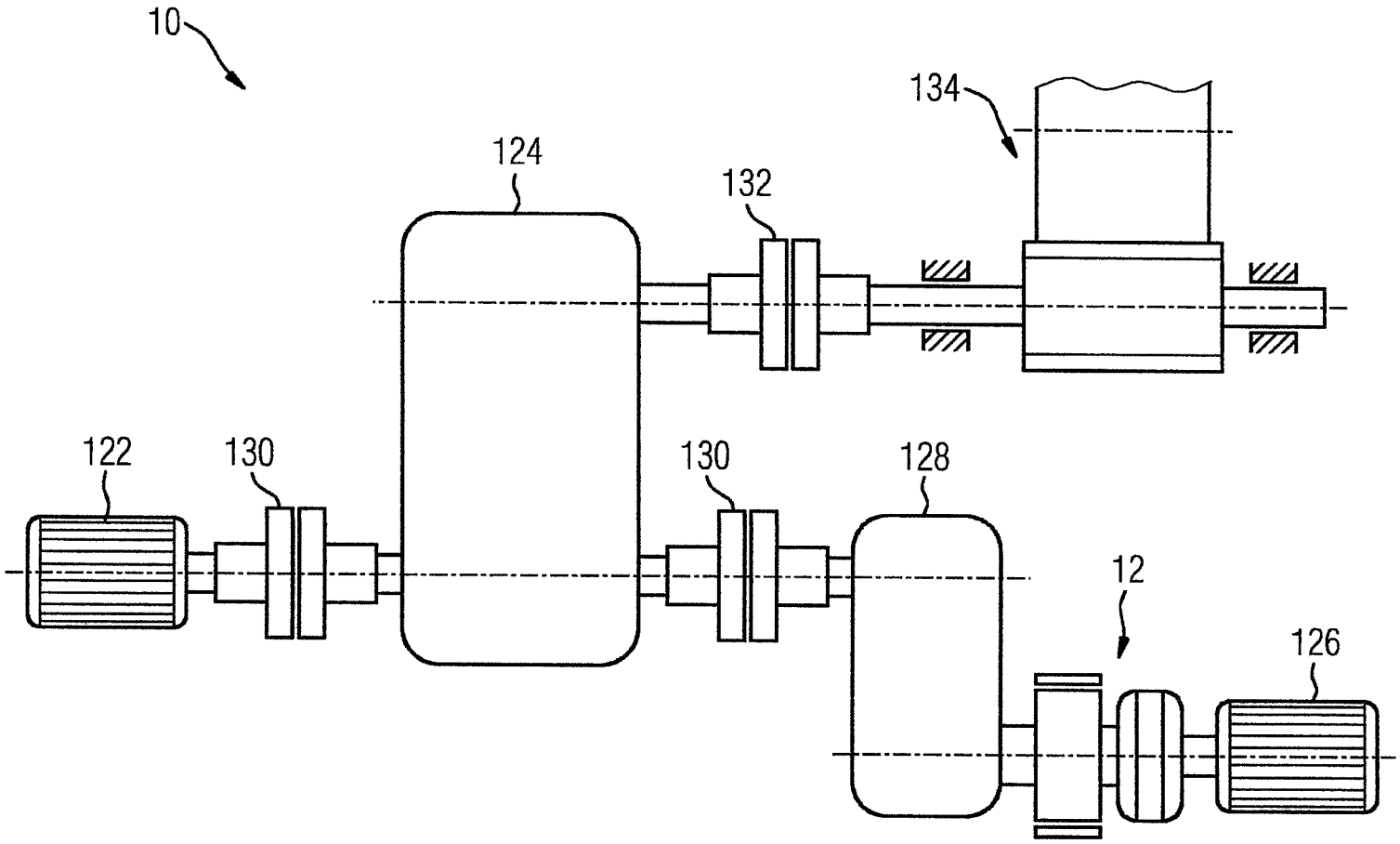
FIG. 5 shows a schematic representation of a typical drive facility for the powered rotation of a grinding tube in accordance with the invention.

FIG. 5 shows a schematic view of a typical drive facility 10 for the driven rotation of a grinding tube 6. The drive facility 10 has a main drive 122, a main gearbox 124, an auxiliary drive 126, an auxiliary gearbox 128, two auxiliary clutches 130 and a main clutch 132. The braking facility 12 is arranged between the auxiliary drive 126 and the auxiliary gearbox 128, where the braking facility 12 can also be arranged in another position or structurally separated from the drive facility 10. The drive facility 10 works on a ring gear 134, which can be arranged on a circumference of the grinding tube 6.

Figure 6:
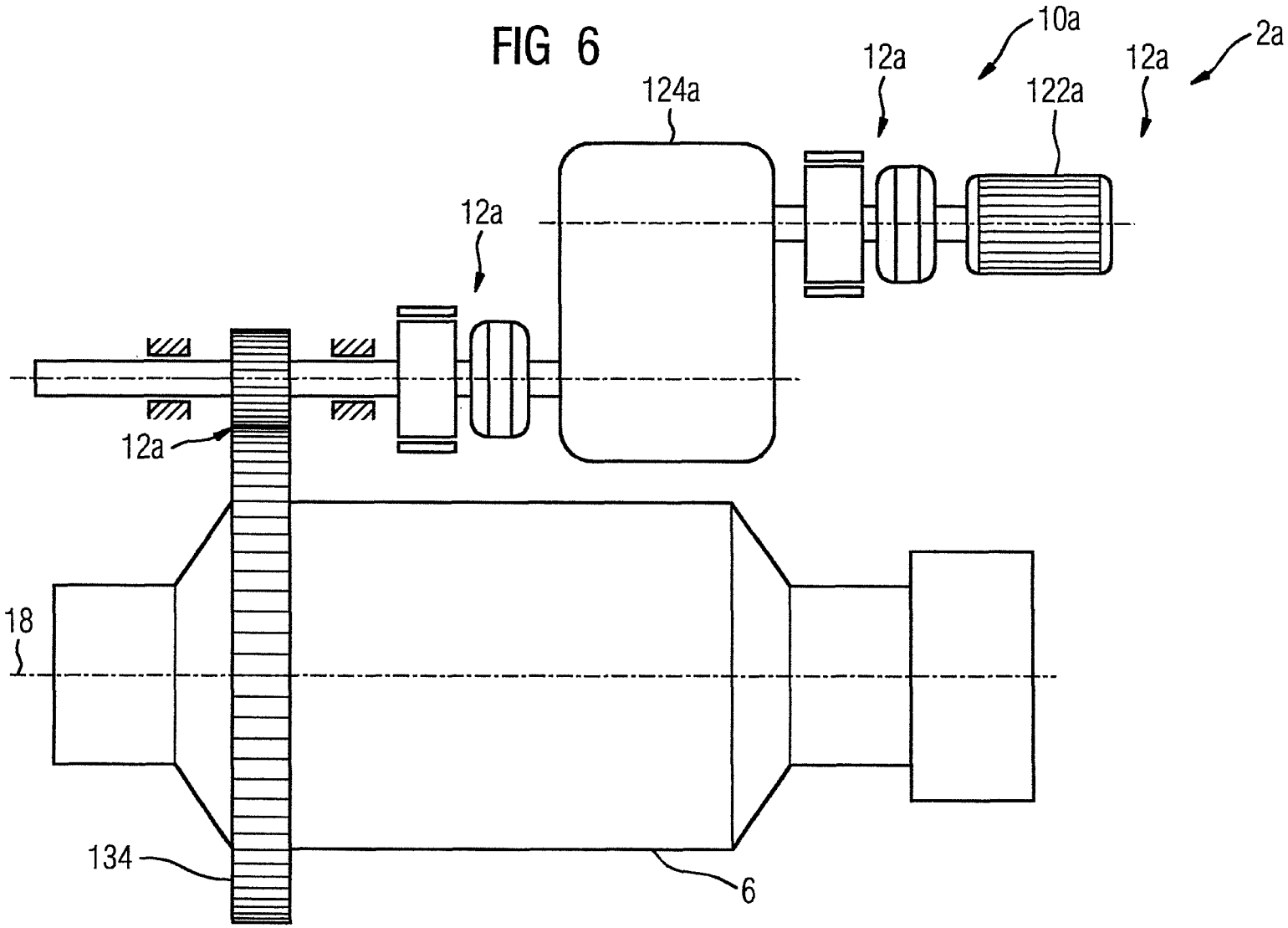
FIG. 6 shows a schematic representation of a tube mill in plan view in accordance with the invention.

FIG. 6 shows a schematic diagram of a tube mill 2*a* in plan view. The tube mill 2*a* has a grinding tube 6 that has a bearing mount so that it can rotate about an axis of rotation 18, a drive facility 10*a* with a main drive 122*a* and a main gearbox 124*a*. The drive facility 10*a* works on the ring gear 134. In addition, the tube mill 2*a* has several braking facilities 12*a*. These are mounted between the main drive 122*a* and the main gearbox 124*a*, on the drive offtake side on the main gearbox 124*a* and on the ring gear 134.

Figure 7:
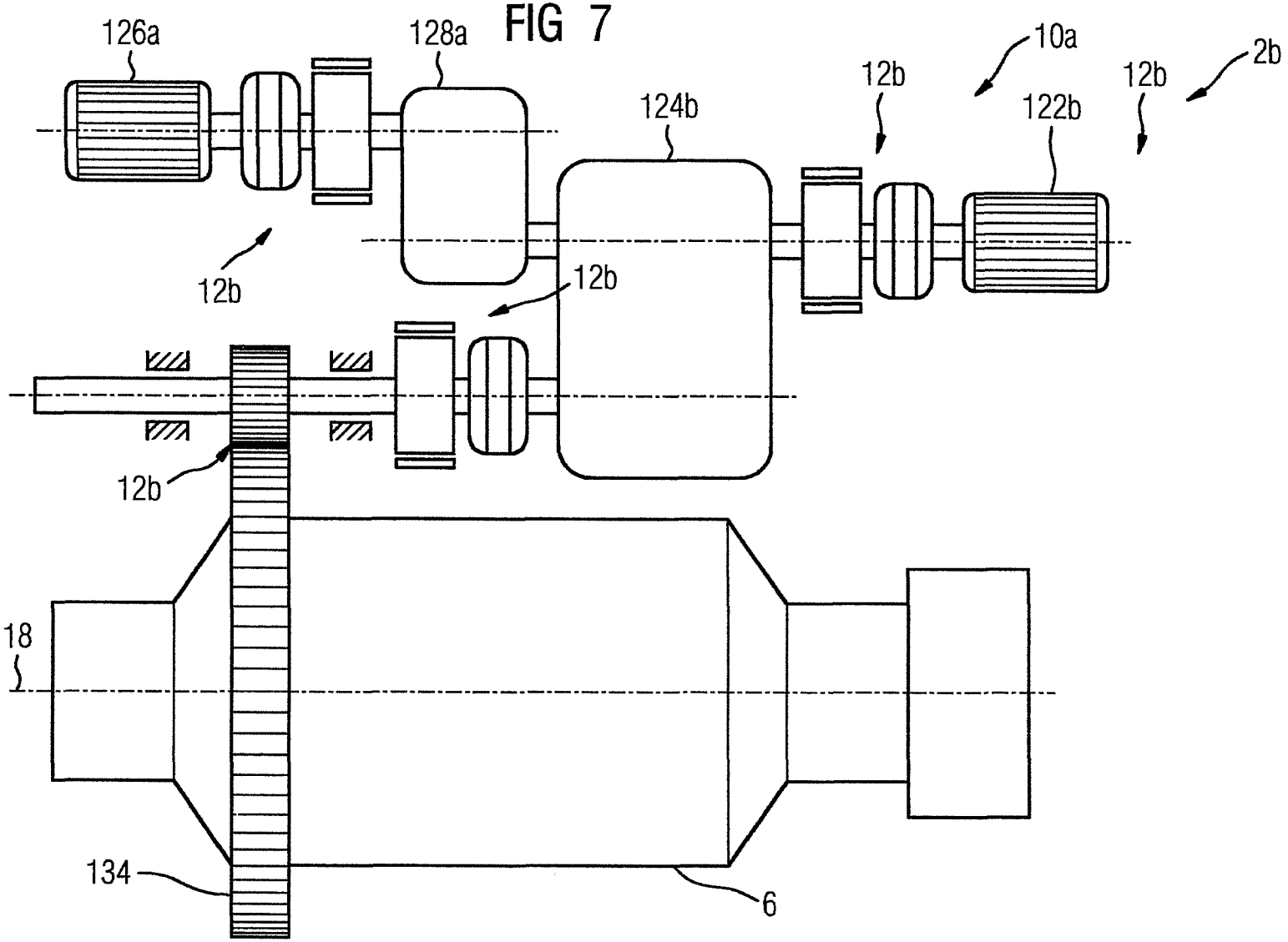
FIG. 7 shows a schematic representation of another tube mill in plan view in accordance with the invention.

FIG. 7 shows a schematic diagram of another tube mill 2*b* in plan view. The tube mill 2*b* has a grinding tube 6 that has a bearing mount so that it can rotate about an axis of rotation 18, a drive facility 10*b* with a main drive 122*b* and a main gearbox 124*b*, an auxiliary drive 126*a* and an auxiliary gearbox 128*a*. The drive facility 10*b* works on the ring gear 134. In addition, the tube mill 2*b* has several braking facilities 12*b*. These are mounted between the main drive 122*b* and the main gearbox 124*b*, on the drive offtake side on the main gearbox 124*b*, between the auxiliary drive 126*a* and the auxiliary gearbox 128*a*, on the drive offtake side on the auxiliary gearbox 128*a* and on the ring gear 134.

Figure 8:
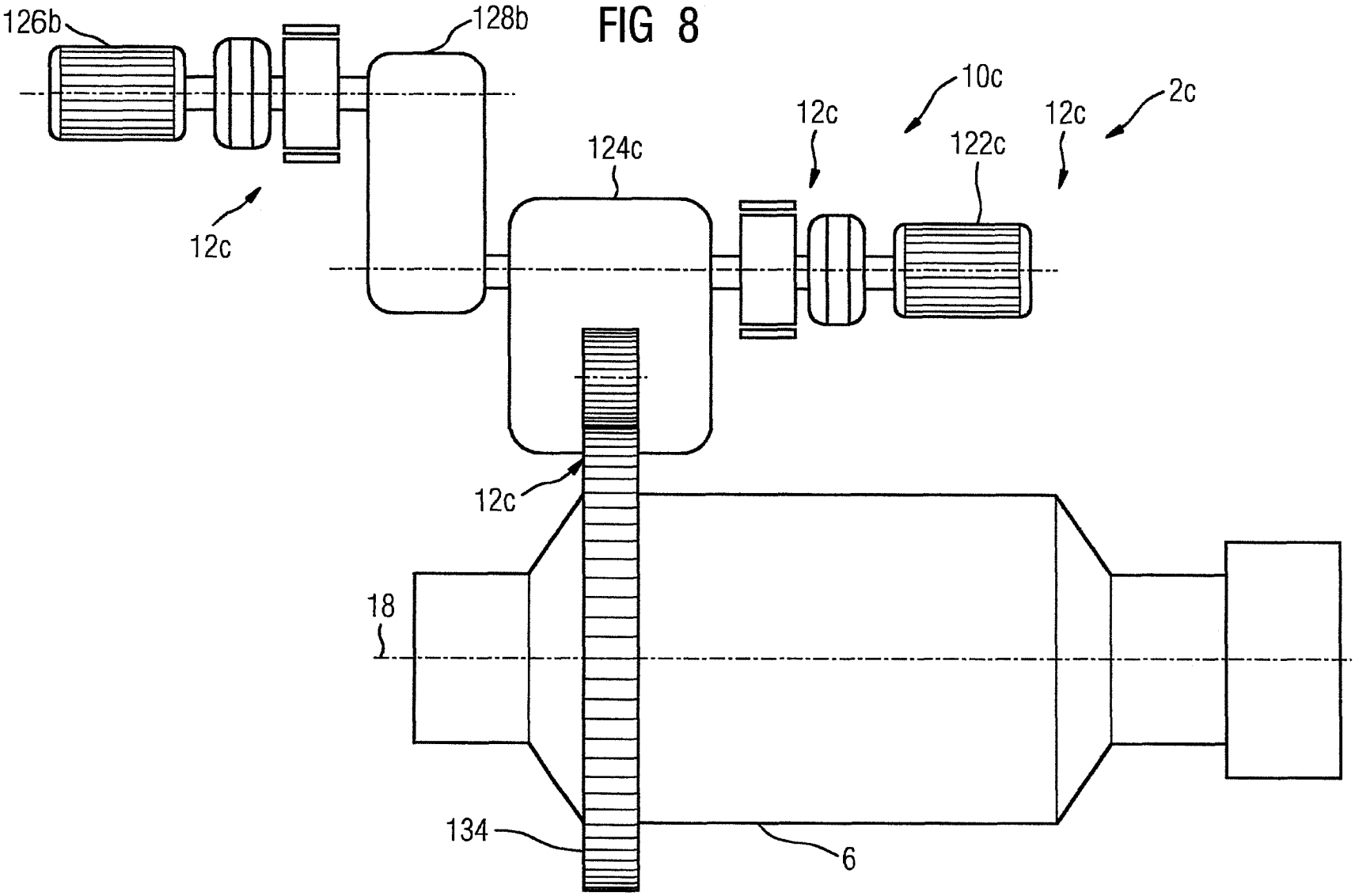
FIG. 8 shows a further schematic representation of another tube mill in plan view.

FIG. 8 shows a schematic diagram of another tube mill 2*c* in plan view. The tube mill 2*c* has a grinding tube 6 that has a bearing mount so that it can rotate about an axis of rotation 18, a drive facility 10*c* with a main drive 122*c*, a main gearbox 124*c*, an auxiliary drive 126*b* and an auxiliary gearbox 128*b*. Here, the main gearbox 124*c* of the drive facility 10*c* works directly on the ring gear 134. In addition, the tube mill 2*c* has several braking facilities 12*c*. These are mounted between the main drive 122*c* and the main gearbox 124*c*, between the auxiliary drive 126*b* and the auxiliary gearbox 128*b*, on the auxiliary drive 126*b* and on the ring gear 134.

Figure 9:
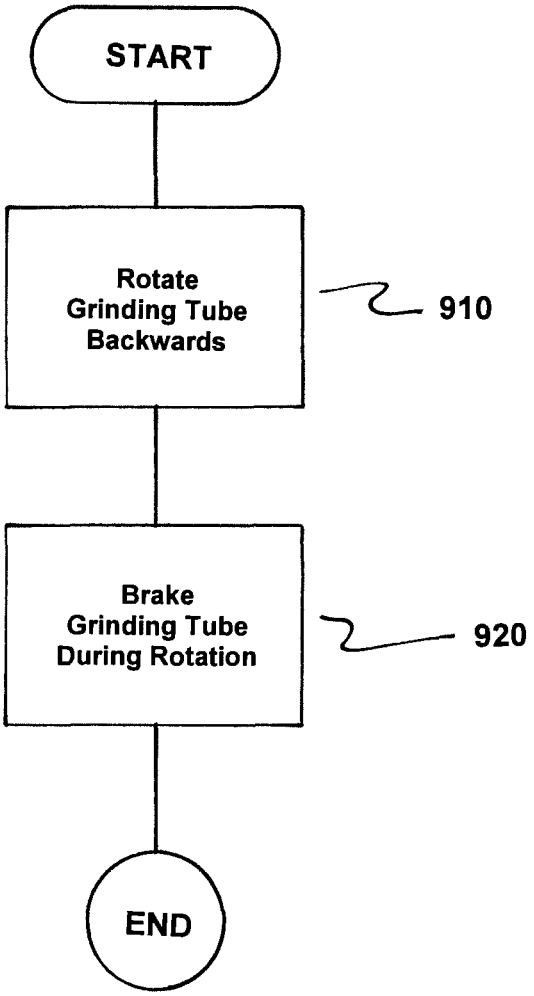
FIG. 9 is a flowchart of the method in accordance with the invention.

FIG. 9 is a flowchart of the method for releasing an adhering charge (22) from an inner wall (20) of a grinding tube (6). The method comprises rotating the grinding tube (6) backwards from a pre-determinable rotational position (28) adopted by said grinding tube (6), with no drive, due to a weight force (30) of the adhering charge (22), as indicated in step 910.

Here, at least one movement state variable (40) of the grinding tube (6) is detected.

Next, during the backwards rotation, the grinding tube (6) is braked as a function of the at least one movement state variable (40) which has been detected to release the adhering charge (22) from the inner wall (20) of the grinding tube, as indicated in step 920.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those element steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for releasing an adhering charge from an inner wall of a grinding tube, the method comprising:

rotating the grinding tube backwards autonomously from a pre-determinable rotational position adopted by said grinding tube, with no drive, due to a weight force of the adhering charge, at least one movement state variable of the grinding tube being detected during the autonomous backwards rotation; and braking the grinding tube, during the autonomous backwards rotation, as a function of the at least one movement state variable to release the adhering charge from the inner wall of the grinding tube.

2. The method as claimed in claim 1, wherein the pre-determinable rotational position is reached by a driven rotation, for which a drive facility of the grinding tube is utilized.

3. The method as claimed in claim 1, wherein the pre-determinable rotational position of the grinding tube is pre-determined as a rotational angle determined as a function of a characteristic of the charge.

4. The method as claimed in claim 1, wherein the pre-determinable rotational position of the grinding tube is pre-determined as a rotational angle with a magnitude of between 40° and 90° starting from a stable position of equilibrium.

5. The method as claimed in claim 1, wherein the at least one movement state variable which is detected is at least one of a rotational angle, an angular rotational speed and an angular rotational acceleration of the grinding tube.

6. The method as claimed in claim 1, wherein the grinding tube is braked to a halt at least once during the backwards rotation.

7. The method as claimed in claim 1, wherein the grinding tube is braked at least once with a pre-determinable deceleration during the backwards rotation.

8. The method as claimed in claim 7, wherein the pre-determinable deceleration is determined as a function of a characteristic of the charge.

9. The method as claimed in claim 7, wherein the pre-determinable deceleration is determined as a function of a mechanical stress limit for the grinding tube.

* * * * *